US007307594B2

(12) United States Patent
Noguchi

(10) Patent No.: US 7,307,594 B2
(45) Date of Patent: Dec. 11, 2007

(54) ELECTRONIC APPARATUS HAVING ANTENNA

(75) Inventor: Eriko Noguchi, Chiba (JP)

(73) Assignee: Seiko Instruments Inc. (JP)

( * ) Notice: Subject to any disclaimer, the term of this patent is extended or adjusted under 35 U.S.C. 154(b) by 103 days.

(21) Appl. No.: 11/267,774

(22) Filed: Nov. 3, 2005

(65) Prior Publication Data

US 2006/0097951 A1 May 11, 2006

(30) Foreign Application Priority Data

Nov. 11, 2004 (JP) ..... 2004-327203

(51) Int. Cl.
*H01Q 1/12* (2006.01)

(52) U.S. Cl. ..... 343/718; 343/787

(58) Field of Classification Search ..... 343/702, 343/718, 787

See application file for complete search history.

(56) References Cited

U.S. PATENT DOCUMENTS

| | | | | |
|---|---|---|---|---|
| 4,947,179 | A * | 8/1990 | Ganter et al. | 343/718 |
| 2005/0078045 | A1* | 4/2005 | Sano | 343/788 |

FOREIGN PATENT DOCUMENTS

| | | |
|---|---|---|
| DE | 19607806 | 9/1996 |
| EP | 1420477 | 5/2004 |
| JP | 03060520 | 2/2003 |
| JP | 200343167 | 2/2003 |
| JP | 3526874 | 2/2004 |
| WO | 0703513 | 3/1996 |
| WO | 9763798 | 11/1997 |

* cited by examiner

*Primary Examiner*—Tho Phan
(74) *Attorney, Agent, or Firm*—Adams & Wilks

(57) ABSTRACT

To be able to downsize an electronic apparatus having an antenna having a plurality of antenna coils. A radio wave timepiece includes an antenna for receiving a radio wave signal including time information and the antenna is provided not to be projected from a contour of a timepiece movement. The antenna includes a plurality of antenna coils wound to laminate on a core, when the antenna 101 is used by being contained in a metal cabinet, the antenna coil wound around an upper layer and having a large inductance value is used, when the antenna is used by being contained in a plastic cabinet, the antenna coil wound around a lower layer and having a small inductance value is used, thereby, regardless of a kind of the cabinet, the radio wave timepiece can be downsized and a predetermined radio wave receiving sensitivity can be achieved.

8 Claims, 3 Drawing Sheets

ELECTRONIC APPARATUS HAVING ANTENNA

BACKGROUND OF THE INVENTION

1. Field of the Invention

The present invention relates to an electronic apparatus having an antenna for receiving radio waves by an antenna coil.

2. Description of the Prior Art

In a background art, there has been developed an electronic apparatus having an antenna of a radio wave timepiece, a portable telephone or the like.

According to the electronic apparatus having an antenna of the background art, there is used an antenna apparatus for receiving radio waves by winding an antenna coil around an antenna magnetic core member referred to as a core.

For example, according to radio wave timepieces disclosed in Patent Reference 1, Patent Reference 2, in order to deal with frequencies or the like of a plurality of different long standard radio waves, there is disclosed an antenna having a plurality of coils at a core, changing inductances thereof by switching by a switch to thereby enable to change tuning frequencies.

Although a receiving sensitivity of an antenna is influenced by a volume of a core and a coil volume, when a plurality of coils are provided as in the background art, there is needed a nonwinding portion for connecting antennas disposed at both ends of the core. Therefore, in order to provide a predetermined necessary coil volume, it is necessary to increase turn numbers of the respective coils by enlarging the core to pose a problem that a size thereof is enlarged.

This poses a serious problem particularly in a portable electronic apparatus having an antenna of a portable radio wave timepiece, a portable telephone or the like requested to be downsized.

Further, although Patent References 1, 2, mentioned above, disclose a radio wave timepiece having a plurality of tuning circuits, the tuning circuits are for tuning to frequencies different from each other (for example, 40 kHz and 60 kHz) and are not for tuning to the same frequency.

<Patent Reference 1> JP-A-2003-60520

<Patent Reference 2> Japanese Patent Publication No. 3526874

It is a problem of the invention to provide an electronic apparatus having an antenna having a plurality of antenna coils which can be downsized.

SUMMARY OF THE INVENTION

According to the invention, there is provided an electronic apparatus having an antenna having a plurality of antenna coils, characterized in that the plurality of antenna coils are constituted by being wound to laminate on a plurality of layers.

Here, there may be constructed a constitution in which inductance values of the plurality of antenna coils differ from each other.

Further, there may be constructed a constitution in which the plurality of antenna coils wound to laminate on the plurality of layers are constituted by a first coil wound around a lower layer and a second coil wound around an upper layer of the first antenna coil and the inductance value of the first antenna coil is smaller than the inductance value of the second antenna coil.

Further, there may be constructed a constitution in which when the first and the second antenna coils are contained in a plastic cabinet, the first antenna coil is used as the antenna and when the first and the second antenna coils are contained in a metal cabinet, the second antenna coil is used as the antenna.

Further, there may be constructed a constitution further comprising a timepiece movement, wherein the antenna coils wound around the plurality of layers are constituted by being arranged in the timepiece movement so as not to be projected from a contour of the timepiece movement.

Further, there may be constructed a constitution in which terminals of the respective antenna coils are constituted by being electrically connected to a lead board.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

An electronic apparatus having an antenna according to an embodiment of the invention will be explained as follows.

Figure 1:
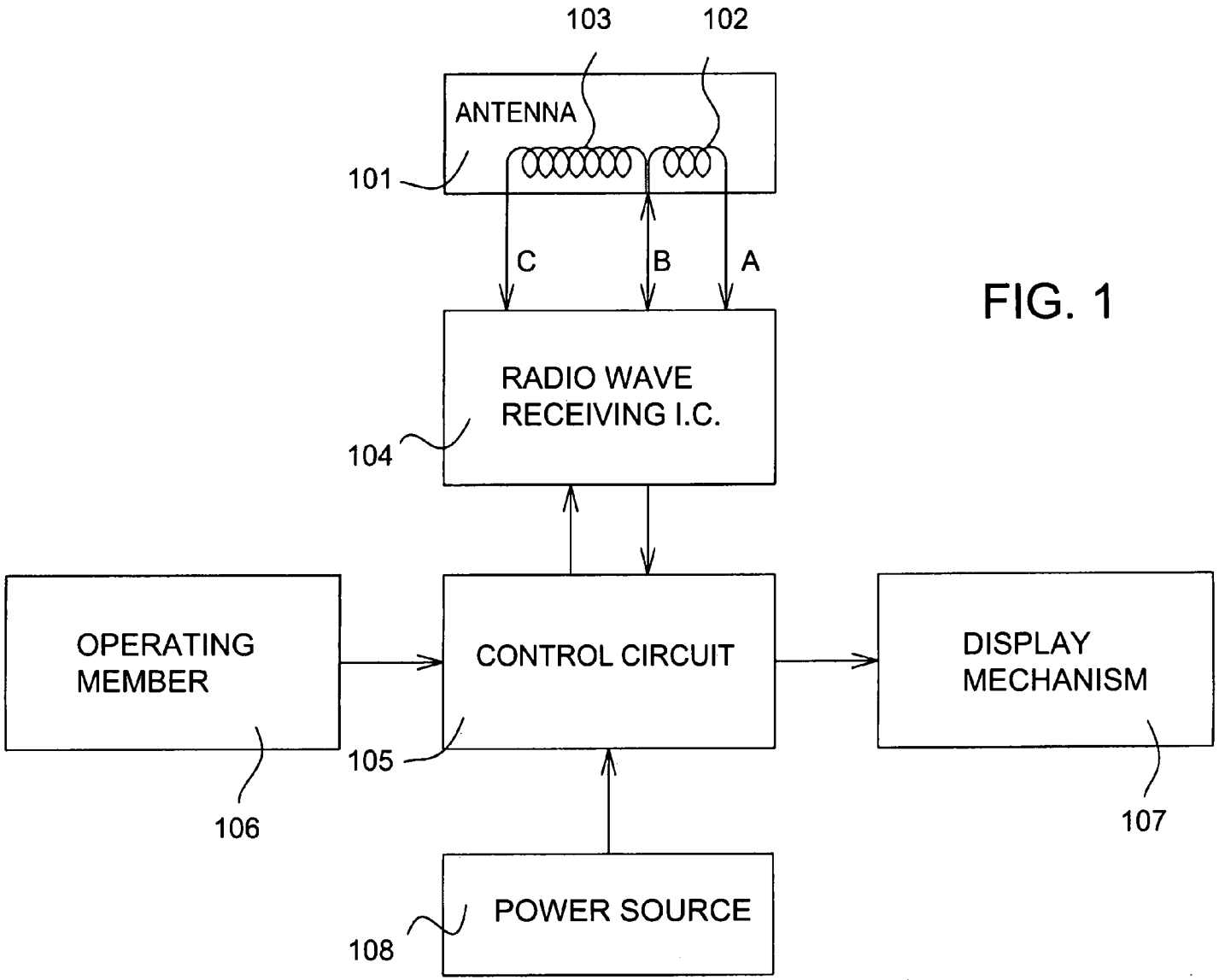
FIG. 1 is a block diagram of a radio wave timepiece according to an embodiment of the invention.

FIG. 1 is a block diagram of an electronic apparatus having an antenna according to the embodiment of the invention, showing an example of a radio wave timepiece for receiving a time code signal including information of current time by a radio wave signal and correcting time counted by counting means by the information of the current time included in the time code signal.

In FIG. 1, the radio wave timepiece includes an antenna 101, a radio wave receiving IC (integrated circuit) 104 constituting a radio wave receiving portion, a control circuit 105 for controlling respective constituent elements of the radio wave timepiece, an operating member 106 of a winding crown or the like, a display mechanism 107 as displaying means for displaying time or the like based on a time signal from the control circuit 105, and a power source 108 for supplying a power to the respective constituent elements.

The radio wave receiving IC 104 includes an AGC amplifying circuit for amplifying a signal received by the antenna 101, and a decoding circuit for extracting a time code signal representing current time from an output signal of the AGC amplifying circuit.

The display mechanism 107 is constituted by time hands including an hour hand and a minute hand and a driving mechanism in the case of an analog display type radio wave timepiece and is constituted by a liquid crystal display apparatus or the like in the case of a digital display type radio wave timepiece.

The antenna 101 includes a plurality of antenna coils (first antenna coil 103, second antenna coil 102) for receiving radio wave signals including time information (long standard radio wave signals in Japan). The antenna coils 102, 103 are respectively connected to capacitors, not illustrated. The antenna coils 102, 103 and the capacitors in correspondence therewith constitute tuning circuits having tuning frequencies which are the same as each other and having the tuning frequencies the same as a frequency of the radio wave signal (for example, 40 kHz).

The antenna coil 102 is the antenna coil having an inductance value larger than an inductance value of the antenna coil 103 and achieving an excellent receiving sensitivity by being used when a cabinet (outfit) for containing the antenna 101 comprises a metal (for example, stainless steel, titanium). The antenna coil 103 is the antenna coil having the inductance value smaller than the inductance value of the antenna coil 102 and achieving an excellent receiving sensitivity by being used when the cabinet containing the antenna 101 comprises plastic.

Further, as mentioned later, it is previously selected in fabrication to use one of the plurality of antenna coils (antenna coil 102 and antenna coil 103) in accordance with a kind of a material or the like of the cabinet.

The radio wave receiving IC 104 extracts the time code signal including the information of the current time by decoding the radio wave signal received by the tuning circuit previously selected from a tuning circuit including the antenna coil 102 and a tuning circuit including the antenna coil 103 in accordance with the kind of the cabinet and outputs the time code signal to the control circuit 105. The control circuit 105 corrects current time counted by counting means provided inside of the control circuit based on the time code signal for display by the display mechanism 107. Thereby, the correct current time is displayed by the display mechanism 107.

In this way, the antenna coil having the pertinent characteristic is selected to be used in accordance with the kind of the cabinet for containing the antenna 101 and therefore, radio wave can excellently be received without being influenced by a material of the cabinet of the radio wave timepiece.

Further, there can also be constructed a constitution in which a selector is provided inside of the radio wave receiving IC 104 and is automatically switched to receive the signal of the antenna coil of either of the antenna coils 102, 103. In this case, the control circuit 105 controls the selector to switch the antenna coil receiving the radio wave to the other antenna coil under a predetermined condition in which the correct time code signal cannot be received from the radio wave receiving IC 104 by the antenna coil currently used. Thereby, the radio wave can excellently be received automatically by restraining the influence of the material of the cabinet containing the antenna 101 on the receiving sensitivity.

Figure 2:
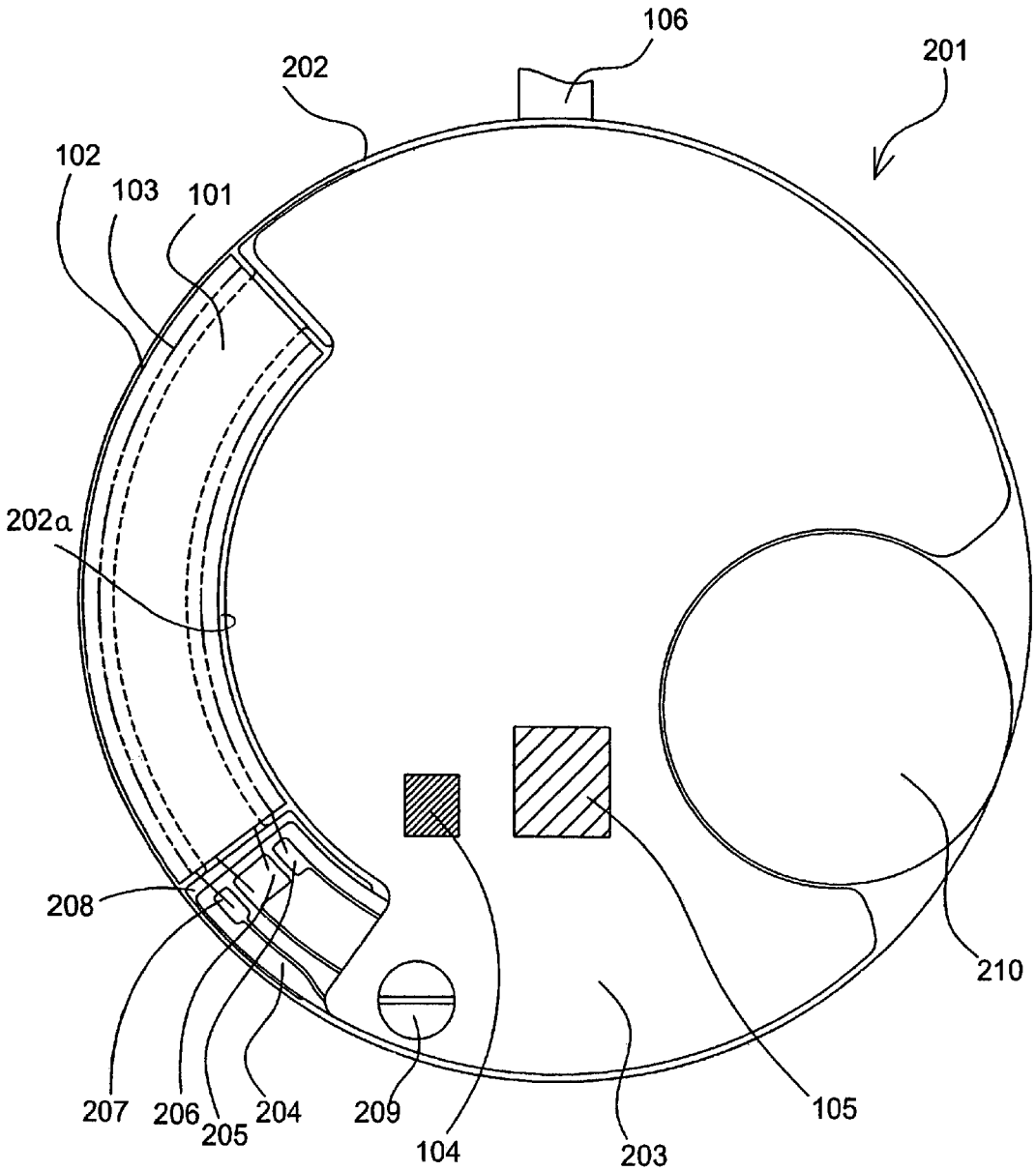
FIG. 2 is a front view showing an inner constitution of the radio wave-timepiece according to the embodiment of the invention.

FIG. 2 is a front view showing an inner mechanism of the radio wave timepiece shown in FIG. 1, and portions the same as those of FIG. 1 are attached with the same notations.

Figure 3:
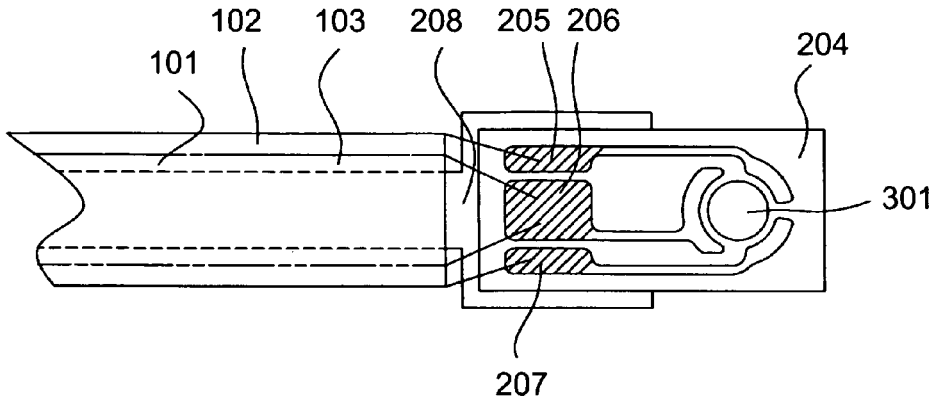
FIG. 3 is a partially enlarged front view of an antenna used in the radio wave timepiece according to the embodiment of the invention.

FIG. 3 is a partially enlarged front view of the antenna used in the radio wave timepiece shown in FIG. 1 and FIG. 2 and portions the same as those of FIG. 1 and FIG. 2 are attached with the same notations.

Figure 4:
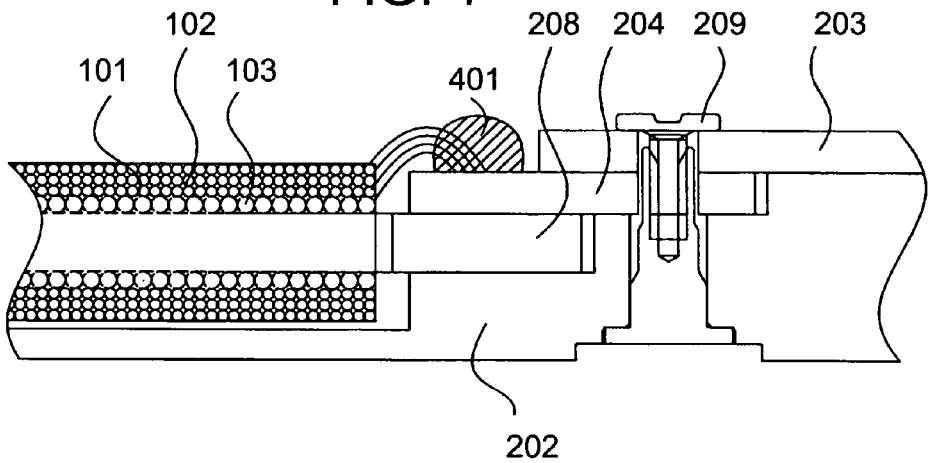
FIG. 4 is a partially enlarged bottom view of the antenna used in the radio wave timepiece according to the embodiment of the invention.

FIG. 4 is a partially enlarged bottom view of the antenna used in the radio wave timepiece shown in FIG. 1 and FIG. 2 and portions the same as those of FIG. 1 through. FIG. 3 are attached with the same notations.

In FIG. 2 through FIG. 4, the radio wave timepiece includes a timepiece movement 201 having a contour in a shape of a circular disk. The timepiece movement 201 includes a frame 202 in a shape of a circular disk. A battery 210 constituting the power source 108, a circuit board 203, and the antenna 101 are contained inside of the frame 202.

The radio wave receiving IC 104, the control circuit 105 and the like are soldered to the circuit board 203.

The antenna 101 is disposed in a recessed portion 202*a* of the frame 202, as shown in FIG. 2, such that on part of the antenna 101 projects beyond the contour of the timepiece movement 201. The antenna 101 includes the plurality of antenna coils 102, 103 wound to laminate on a plurality of layers at a single common core 208.

Inductance values of the plurality of antenna coils 102, 103 are constituted to differ from each other. The inductance value of the first antenna coil 103 wound around a lower layer is constituted to be smaller than the inductance value of the second antenna coil 102 wound around an upper layer.

The antenna coil 102 is an antenna coil achieving an excellent receiving sensitivity when the antenna coil 102 is used in the case in which a cabinet or other enclosure containing the antenna 101 comprises a metal and the antenna coil 103 is an antenna coil achieving an excellent receiving sensitivity when the antenna coil 103 is used in the case in which the cabinet or other enclosure containing the antenna 101 comprises plastic.

A winding of the antenna coil 103 wound around the lower layer is constituted by a winding of a conductor of lager diameter than a winding of the antenna coil 102 formed around the upper layer.

Terminals of the antenna coils 102, 103 are electrically connected to a lead board 204. That is, one end of the antenna coil 103 is electrically connected to a copper foil pattern 207 provided at the lead board 204 and other end thereof is electrically connected to a copper foil pattern 206. Further, one end of the antenna coil 102 is electrically connected to the copper foil pattern 206 and other end thereof is electrically connected to a copper foil pattern 205. Portions of connecting the respective terminals of the antenna coils 102, 103 and the lead board 204 are covered by a mold agent 401.

In fabricating the antenna 101, one end of a conductor winding for the antenna coil 103 having a larger wire diameter is subjected to terminal processing of soldering or the like at the copper foil pattern 207, the conductor winding is wound around a core 208 by a predetermined number of times and thereafter, other end of the winding is subjected to terminal processing of soldering or the like at the copper foil pattern 206.

Next, a conductor winding for the antenna coil 102 having a wire diameter smaller than that of the conductor winding for the antenna coil 103 is subjected to terminal processing of soldering or the like at the copper foil pattern 206, the conductor winding is wound around an upper layer of the winding of the antenna coil 102 by a predetermined number of times and thereafter, other end of the winding is subjected to terminal processing of soldering or the like at the copper foil pattern 205.

The lead board 204 and the circuit board 203 are integrally fixed to the frame 202 by a screw 209 via a through hole 301, thereby, the lead board 204 and the circuit board 203 are electrically connected.

When the antenna coil 102 is used as the antenna, the copper foil patterns 205, 206 are electrically connected to the circuit board 203 which is subjected to a processing of soldering of the like to connect a tuning circuit including the antenna coil 102 to the radio wave receiving IC 104. On the other hand, when the antenna coil 103 is used, the copper foil patterns 206, 207 are electrically connected to the circuit board 203 which is subjected to a processing of soldering or the like to connect a tuning circuit including the antenna coil 103 to the radio wave receiving IC 104. Further, when the antenna coils 102, 103 are constituted to be selected automatically as described above, both of the antenna coils 102, 103 may electrically be connected to the radio wave receiving IC 104.

Meanwhile, as described above, when an antenna coil is put into a metal cabinet, a sensitivity thereof is reduced. This is because by placing a metal proximate to an antenna coil, a series equivalent resistance of the antenna coil is increased and a Q value is reduced and because an impedance of an antenna circuit is changed and impedance matching with a receiving circuit is shifted. Further, although in the case of a single member of antenna, the smaller the inductance, the more excellent the sensitivity, when the antenna is enclosed in a metal cabinet, the larger the inductance, the more excellent the sensitivity.

Figure 5:
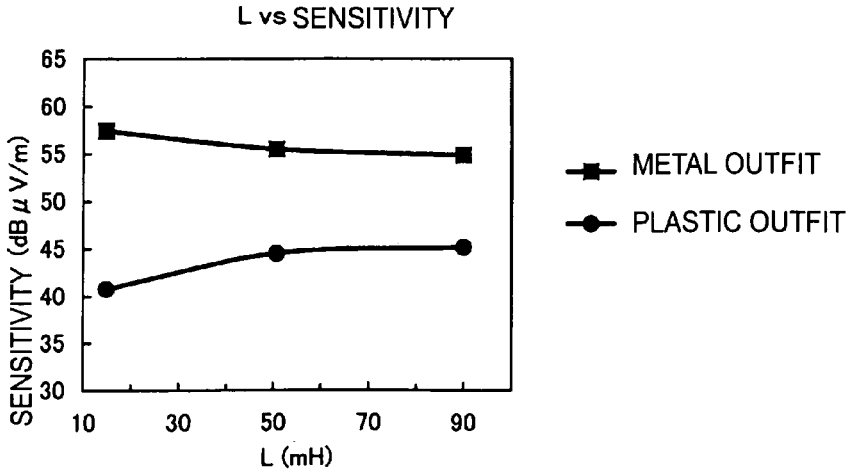
FIG. 5 is a diagram showing a characteristic of the radio wave timepiece according to the embodiment of the invention.

The relationship is shown in FIG. 5. FIG. 5 is a characteristic diagram showing the relationship between inductance L of a tuning circuit including an antenna coil and sensitivity for a case in which the tuning circuit is placed in a plastic enclosure or cabinet (outfit) and a case in which the tuning circuit is placed in a metal enclosure or cabinet (outfit). The abscissa designates the inductance L (mH) of the antenna coil and the ordinate designates the sensitivity (dBμV/m) of a receiving circuit 10.

As is apparent from FIG. 5, in the case of larger inductance of an antenna coil (antenna coil 102), a degree of a reduction in a sensitivity when the antenna coil is put into a metal cabinet is alleviated and therefore, the larger inductance constitutes a characteristic advantageous for the metal cabinet. On the other hand, when it is assumed to enclose an antenna coil in a cabinet having a small influence of a metal as in plastic, a smaller inductance (antenna coil 103) constitutes a characteristic advantageous in view of the sensitivity.

In this way, since the optimum inductance value of the antenna coil differs between the case in which the cabinet of enclosing a radio wave timepiece module comprises plastic and the case in which the cabinet comprises a metal, as in the embodiment, by providing a plurality of antenna coils (tuning circuits) respectively optimized for the plastic cabinet and for the metal cabinet and switching to select to use the antenna coil having a pertinent characteristic in accordance with a kind of a cabinet in fabrication, or switching to automatically select the antenna coil having a suitable characteristic under a predetermined condition, regardless of the kind of the cabinet, the radio wave timepiece module having an excellent receiving sensitivity and having high general purpose performance can be realized.

As described above, according to the embodiment, the plurality of antennas 102, 103 are wound one over the other in a plurality of layers on the core 208 and therefore, a space of arranging the coils can be reduced and the radio wave timepiece can be downsized.

Further, since there is constituted the structure in which the plurality of antenna coils are wound by a number of layers as described above, there can be constructed a constitution of restraining an influence on the receiving sensitivity effected in accordance with the kind of the cabinet for containing the antenna and therefore, it is not necessary in the case of a radio wave timepiece to prepare a plurality of kinds of movement in correspondence with an environment and a plurality of environments can be dealt with by using the same movement.

Further, although generally, when a radio wave timepiece is placed on a metal, a receiving characteristic thereof is changed, even in such a case, according to the embodiment, there is achieved an effect of capable of realizing an optimum receiving state regardless of an environment in which the radio wave timepiece is placed.

The invention is applicable to various kinds of electronic apparatus having antennas starting from portable electronic apparatus having antennas of a portable radio wave timepiece, a portable telephone, PHS (personal handyphone system) and the like. Further, the invention is not limited to cases in which cabinets comprise a metal and plastic and applicable to electronic apparatus having antennas using cabinets of various materials. Further, in the case of a radio wave timepiece, the invention is applicable also to radio wave timepieces used not only in Japan but also in the countries having different frequencies of the United States of America or the like.

According to the invention, an electronic apparatus having an antenna having a plurality of antenna coils can be downsized.

Further, there can be constructed a constitution in which a change in a receiving sensitivity brought about in accordance with a kind of a cabinet for containing an antenna is restrained. Therefore, according to a radio wave timepiece, there is achieved an effect in which it is not necessary to prepare a plurality of kinds of timepiece movements having receiving characteristics in accordance with cabinets for containing antennas and a plurality of kinds of cabinets can be dealt with by using the same timepiece movement.

What is claimed is:

1. An electronic apparatus having an antenna comprised of a first antenna coil wound around a core and a second antenna coil wound around the first antenna coil, wherein the inductance value of the first antenna coil is smaller than the inductance value of the second antenna coil, and wherein when the first and the second antenna coils are contained in a plastic cabinet, the first antenna coil is used as the antenna and when the first and the second antenna coils are contained in a metal cabinet, the second antenna coil is used as the antenna.

2. An electronic apparatus having an antenna according to claim 1; further comprising a timepiece movement; wherein the first and second antenna coils are disposed in the timepiece movement such that no part of the first and second antenna coils protrudes beyond a contour of the timepiece movement.

3. An electronic apparatus having an antenna according to claim 1; wherein terminals of the respective antenna coils are electrically connected to a lead board.

4. An electronic apparatus comprising: an enclosure made primarily of either metal or plastic; an antenna adapted to receive a radio wave signal and contained within the enclosure, the antenna comprising a first antenna coil wound around a core and a second antenna coil wound around the first antenna coil, the first antenna coil having an inductance value smaller than that of the second antenna coil; and a radio wave receiving portion contained within the enclosure and connected to receive the radio wave signal from the first antenna coil if the enclosure is made primarily of plastic or connected to receive the radio wave signal from the second antenna coil if the enclosure is made primarily of metal.

5. An electronic apparatus according to claim 4; further including a lead board having a conductor pattern connected to terminals of one of the first and second antenna coils.

6. An electronic apparatus according to claim 5; further including a printed circuit board electrically connected to the conductor pattern of the lead board and to the radio wave receiving portion.

7. An electronic apparatus according to claim 6; further including a timepiece movement disposed within the enclosure, the timepiece movement having a frame that has a recessed portion in which is disposed the antenna.

8. An electronic apparatus according to claim 4; further including a timepiece movement disposed within the enclosure, the timepiece movement having a frame that has a recessed portion in which is disposed the antenna.

* * * * *